US006771777B1

(12) United States Patent
Gbur et al.

(10) Patent No.: US 6,771,777 B1
(45) Date of Patent: Aug. 3, 2004

(54) PROCESS FOR CODING AND DECODING STEREOPHONIC SPECTRAL VALUES

(75) Inventors: Uwe Gbur, Berlin (DE); Martin Dietz, Nürnberg (DE); Bodo Teichmann, Nürnberg (DE); Karlheinz Brandenburg, Erlangen (DE); Heinz Gerhauser, Waischenfeld (DE); Jürgen Herre, Buckenhof (DE); James Johnston, Warren, NJ (US)

(73) Assignees: Fraunhofer-Gesellschaft zur Förderung der angewandten Forschung e.V., Munich (DE); AT&T Laboratories/Research, Florham Park, NJ (US); Lucent Technologies, Bell Laboratories, Murray Hill, NJ (US)

( * ) Notice: Subject to any disclaimer, the term of this patent is extended or adjusted under 35 U.S.C. 154(b) by 0 days.

(21) Appl. No.: 09/214,656

(22) PCT Filed: Jun. 3, 1997

(86) PCT No.: PCT/EP97/02874

§ 371 (c)(1),
(2), (4) Date: May 28, 1999

(87) PCT Pub. No.: WO98/03036

PCT Pub. Date: Jan. 22, 1998

(30) Foreign Application Priority Data

Jul. 12, 1996 (DE) ..... 196 28 292

(51) Int. Cl.[7] ..... H04H 5/00
(52) U.S. Cl. ..... 381/2; 704/219
(58) Field of Search ..... 381/17, 22, 23, 381/2; 704/200.1, 229, 219

(56) References Cited

U.S. PATENT DOCUMENTS 5,627,938 A * 5/1997 Johnston ..... 704/229

FOREIGN PATENT DOCUMENTS

| | | | |
|---|---|---|---|
| DE | 33 10 480 | C2 | 10/1984 |
| DE | 42 36 989 | C2 | 5/1994 |
| DE | 43 31 376 | C1 | 11/1994 |
| DE | 196 38 997 | A | 3/1997 |
| EP | 0 612 159 | A | 8/1994 |
| EP | 0 717 503 | A | 6/1996 |
| JP | 59188764 | | 10/1984 |
| JP | 6-29859 | | 1/1987 |
| JP | 5-56007 | | 3/1993 |
| JP | 6-51795 | | 2/1994 |
| JP | 6-161497 | | 6/1994 |
| JP | 7-199993 | | 8/1995 |
| JP | 8-95599 | | 4/1996 |
| WO | WO 95/06984 | A | 3/1995 |

OTHER PUBLICATIONS

International Standard ISO/IEC 11172–3, pp iv to vi 1—12, Coding of moving pictures and associated audio for digital storage media at up to about 1,5 Mbit's—Part 3: Audio, Aug. 1, 1993.

* cited by examiner

*Primary Examiner*—Minsun Oh Harvey
(74) *Attorney, Agent, or Firm*—Dougherty, Clements, & Hofer

(57) ABSTRACT

A method of coding stereo audio spectral values first carries out grouping of those values in scale factor bands, with which scale factors are associated. Sections are formed next, each comprising at least one scale factor band. The spectral values are coded within at least one section with a code book assigned to the section, out of a plurality of code books each with a code book number assigned to it, the number of the code book used being transmitted as side information to the coded stereo audio spectral values. At least one additional code book number is provided, which does not refer to a code book but shows information relevant to the section to which it is assigned. A method of decoding stereo audio spectral values which are partly coded by the intensity stereo process and which have side information uses the relevant information, showing the additional code book numbers, to cancel the existing coding of the stereo audio spectral values.

20 Claims, 3 Drawing Sheets

PROCESS FOR CODING AND DECODING STEREOPHONIC SPECTRAL VALUES

FIELD OF THE INVENTION

The invention relates to coding and decoding of stereo audio spectral values, and particularly to indication of the fact that stereo intensity coding is active.

BACKGROUND ART AND DESCRIPTION OF PRIOR ART

The most advanced audio coding and decoding processes, operating e.g. to the MPEG Layer 3 standard, can compress the data rate of digital audio signals e.g. by a factor of twelve without markedly lowering their quality.

Apart from a great coding gain in the individual channels, e.g. the left channel L and right channel R, the relative redundancy and irrelevance of the two channels are also utilised in the case of stereo. The known methods which have already been used are the so-called MS stereo process (MS=centre-side) and the intensity stereo process (IS process).

The MS stereo process, which is known in the art, substantially utilises the relative redundancy of the two channels, with a sum of the two channels and a difference between them being to calculated, then transmitted as modified channel data for the left and right channel respectively. That is to say, the MS stereo process: has a precisely reconstructing action.

Unlike the MS stereo process, the intensity stereo process chiefly makes use of stereo irrelevance. It should be mentioned in connection with stereo irrelevance that the spatial perception of the human hearing system depends on the frequency of the audio signals perceived. At low frequencies both magnitude information and phase information in the two stereo signals is evaluated by the human hearing system, and perception of high frequency components is based mainly on analysis of the energy-time envelopes of both channels. Thus the exact phase information in the signals in both channels is not relevant to spatial perception. This feature of human hearing is utilised to make use of the stereo-irrelevance for further data reduction of audio signals by the intensity stereo process.

As the stereo intensity process cannot resolve precise local information at high frequencies, it is possible to transmit a joint energy envelope for both channels instead of two separate stereo channels L, R, from an intensity frequency limit defined in the encoder. In addition to the joint energy envelope roughly quantised direction information is also transmitted as side information.

As a channel is only partially transmitted when intensity stereo coding is used, the saving of bits may be up to 50%. It should be noted however that the IS process does not have a precisely reconstructing action in the decoder.

In the IS process hitherto employed in the MPEG standard, Layer 3, the fact that the IS process is active in a block of stereo-audio spectral values is indicated by a so-called mode_extension_bit, and each block has a mode_extension_bit assigned to it.

A theoretical representation of the known IS process is given in FIG. 1. Stereo-audio spectral values for a channel L 10 and a channel R 12 are totalled at a summation point 14 to obtain an energy envelope $I=L_i+R_i$ for the two channels. $L_i$ and $R_i$ here represent the stereo-audio spectral values of the respective channels L and R in any scale factor band. As already mentioned, use of the IS process is only permissible above a certain IS frequency limit, in order to avoid inserting coding errors into the stereo-audio spectral values coded. The left and right channels therefore have to be coded separately within a range from 0 Hz to the IS frequency limit. The IS frequency limit as such is determined in a separate algorithm which does not form part of the invention. From this frequency limit upwards the encoder codes the total signal of the left channel 10 and right channel 12, formed at the summation point 14.

Scaling information 16 for channel L and scaling information 18 for channel R are necessary for decoding in addition to the energy envelope, i.e. the total signal of the left and right channels, which may e.g. be transmitted in the coded left channel. Scale factors for the left and right channels are transmitted in the intensity stereo process as implemented e.g. in MPEG Layer 2. However it should be mentioned here that, in the IS process in MPEG Layer 3 for IS-coded stereo-audio spectral values, intensity direction information is transmitted only in the right channel, and the spectral values are decoded again with this information as explained below.

The scaling information 16 and 18 is transmitted as side information in addition to the coded spectral values of channel L and channel R. A decoder delivers audio signal values decoded in a decoded channel L' 20 and a decoded channel R' 22, and the scaling information 16 for channel R and 18 for channel L is multiplied by the decoded stereo-audio spectral values for the respective channels in an L multiplier 24 and an R multiplier 26, as a means of decoding the originally coded stereo-audio spectral values.

Before IS coding is applied above a certain IS frequency limit or MS coding below that limit the stereo audio spectral values for each channel are grouped into so-called scale factor bands. The bands are adapted to the perception properties of the hearing system. Each band may be amplified with an additional factor, the so-called scale factor, which is transmitted as side information for the particular channel and which constitutes part of the scaling information 16 and 18 in FIG. 1. These factors are responsible for the formation of an interfering noise which is introduced by quantisation, in such a way that it is "masked" in respect of psycho-acoustic aspects and thus becomes inaudible.

FIG. 2*a* shows a format of the coded right channel R, used e.g. in an MPEG Layer 3 audio coding process. Any further mention of intensity stereo coding will relate to the MPEG layer 3 standard process. The individual scale factor bands 28, into which the stereo audio spectral values are grouped, are shown diagrammatically in the first line of FIG. 2*a*. In FIG. 2*a* these bands are shown equal in width purely for clarity; in practice their widths will not be equal, owing to the psycho-acoustic properties of the hearing system.

The second line of FIG. 2*a* contains coded stereo audio spectral values sp, which are non-zero below an IS frequency limit 32; the stereo audio spectral values in the right channel above the IS frequency limit are set to zero (zero_part) nsp, as already mentioned (nsp=zero spectrum).

The third line of FIG. 2 contains part of the side information 34for the right channel. The part of the information 34 shown firstly comprises the scale factors skf for the range below the IS frequency limit 32 and the direction information rinfo 36 for the range above the frequency limit. The direction information is used to ensure rough local resolution of the IS coded frequency range in the intensity stereo process. Thus the direction information rinfo 36, also referred to as intensity positions (is_pos), is transmitted in the fight channel instead of the scale factors. It should be mentioned again that the scale factors 34 corresponding to the scale factor bands 28 are still present in the right channel below the IS frequency limit. The intensity positions 36 indicate the perceived stereo imaging position (the ratio of left to right) of the signal source within the respective scale factor bands 28. In each band 28 above the IS frequency limit the decoded values of the stereo audio spectral values transmitted are scaled by the MPEG Layer 3 process, with the following scaling factors $k_L$ for the left channel and $k_R$ for the right one:

$$k_L = \text{is_ratio}/(1+\text{is_ratio}) \quad (1)$$

and $$k_R = 1/(1+\text{is_ratio}) \quad (2)$$

The equation for is_ratio is as follows:

$$\text{is_ratio} = \tan(\text{is_pos}\cdot\Pi/12) \quad (3)$$

The value is_pos is quantised with 3 bits, only the values from 0 to 6 being valid position values. The left and right channels can be derived from the I signal ($I=L_i+R_i$) in the following two equations:

$$R_i = I\cdot\text{is_ratio}/(1+\text{is_ratio}) = I\cdot k_L \quad (4)$$

$$L_i = I\cdot 1/(1+\text{is_ratio}) = I\cdot k_R \quad (5)$$

$R_i$ and $L_i$ are the intensity stereo decoded stereo audio spectral values. It should be mentioned here that the left channel format is analogous to the right channel format shown in FIG. 2*a,* although the combined spectrum $I=L_i+R_i$ rather than the zero spectrum is to be found above the IS frequency limit 32 in the left channel, and although ordinary scale factors are present rather than direction information is_pos for the left channel. The transition from the quantised total spectral values of non-zero to the zero values in the right channel can implicitly indicate the IS frequency limit to the decoder in MPEG Layer 3 standard.

The transmitted channel L is thus calculated in the encoder as the sum of the left and right channels, and the direction information transmitted may be defined by the following equation:

$$\text{is_pos} = \text{nint}\,[\arctan(\sqrt{E_L}/\sqrt{E_R}).12/\Pi] \quad (6)$$

The nint[x] function represents the "next whole number" function, $E_L$ and $E_R$ being the energy in the respective scale factor bands of the left and right channels. This formulation of the encoder/decoder gives an approximate reconstruction of signals in the left and right channels.

As already mentioned, in known audio coding processes the stereo audio spectral values are grouped into the scale factor bands, the bands being adapted to the perception properties of the hearing system. In the audio coding process to the MPEG Layer 3 standard these bands are divided into exactly three regions, the purpose being to group ranges with the same signal statistics. This is advantageous for, redundancy reduction by means of the known Huffman coding, which now takes place. For each of these regions of scale factor bands 28 one table is selected from a plurality of Huffman tables, where there is the greatest gain from redundancy reduction through Huffman coding by means of the selected Huffman table. The table is indicated in the bit stream of coded data by means of a 5-bit value for each region. There are 30 different tables, tables 4 and 14 being blank.

The non-backward compatible NBC coding process, which is currently being standardised, differs from the MPEG Layer 3 standard audio coding process inter alia, not only in the fact that exactly three regions of scale factor bands are allowed in the bit stream syntax for that process, but in the fact that any number of so-called "sections" may be present and may have any number of scale factor bands. By analogy with the previously described process in MPEG Layer 3, a section has an appropriate Huffman table out of a plurality of such tables allocated to it in order to obtain maximum redundancy reduction, and that table will then be used for decoding. In an extreme case a section may e.g. comprise only one scale factor band. However this is unlikely to happen in practice, as far too much side information would then be required. In the NBC process there are altogether 16 Huffman code book numbers, which are transmitted as 4-bit values. Thus one of the twelve existing code book numbers can be selected.

SUMMARY OF THE INVENTION

The problem of the invention is to provide methods of coding and decoding stereo audio spectral values, where information relevant to coding and decoding is indicated with minimum use of side information.

In accordance with a first aspect of the present invention, this problem is solved by a method of coding stereo audio spectral values, comprising the following steps: grouping the stereo audio spectral values in scale factor bands with which scale factors are associated; forming sections, each comprising at least one scale factor band; coding the stereo audio spectral values within at least one section with a code book, allocated to the at least one section, out of a plurality of code books to each of which a number is assigned, the number of the code book used being transmitted as side information to the coded stereo audio spectral values, wherein at least one additional code book number is provided, which does not refer to a code book but shows information relevant to the section to which it is assigned, and one section has either a code book number or the at least one additional code book number assigned to it, without affecting the amount of side information.

In accordance with a second aspect of the present invention, this problem is solved by a method of decoding coded stereo audio spectral values which have side information, comprising the following steps: detecting a code book number on the basis of the side information for each section of the coded stereo audio spectral values; decoding the stereo audio spectral values of a section, the code book number of which refers to a corresponding code book, using that table; and decoding the stereo audio spectral values of another section with a code book number which does not refer to a code book but shows information relevant to the section to which it is assigned, in accordance with the information shown.

The invention is based on the realization that additional code book numbers which are not used to refer to code books may indicate other information relevant to a section. The "additional" code book numbers are the numbers which do not refer to code books. By 4-bit coding twelve different code book numbers, the numbers 13, 14 and 15 become to some extent freely available to contain other information. In a preferred embodiment of the invention two (no. 14 and no. 15) of the three (no. 13, no. 14 and no. 15) additional code book numbers are used to refer, firstly to intensity coding present in a section, and secondly to the mutual phase position of IS-coded stereo audio spectral values in two stereo channels.

The as yet unused additional code book number 13 may be used to refer to an adaptive Huffman coding.

BRIEF DESCRIPTION OF THE DRAWINGS

Some preferred embodiments of the invention will now be explained with reference to the accompanying drawings, in which.

DETAILED DESCRIPTION OF PREFERRED EMBODIMENTS

A method of coding stereo audio spectral values and the method of decoding stereo audio spectral values which are coded partly by the intensity stereo process, in a first embodiment of the invention, use a novel indication of the presence of intensity stereo coding within a section. In accordance with the invention there are again 16 code book numbers. But in contrast with prior art only the first twelve (no. 1 to no. 12) correspond to real code books. The last and the penultimate code book numbers are now employed to indicate that the stereo intensity process is being used within the section associated with that number.

Figure 1:
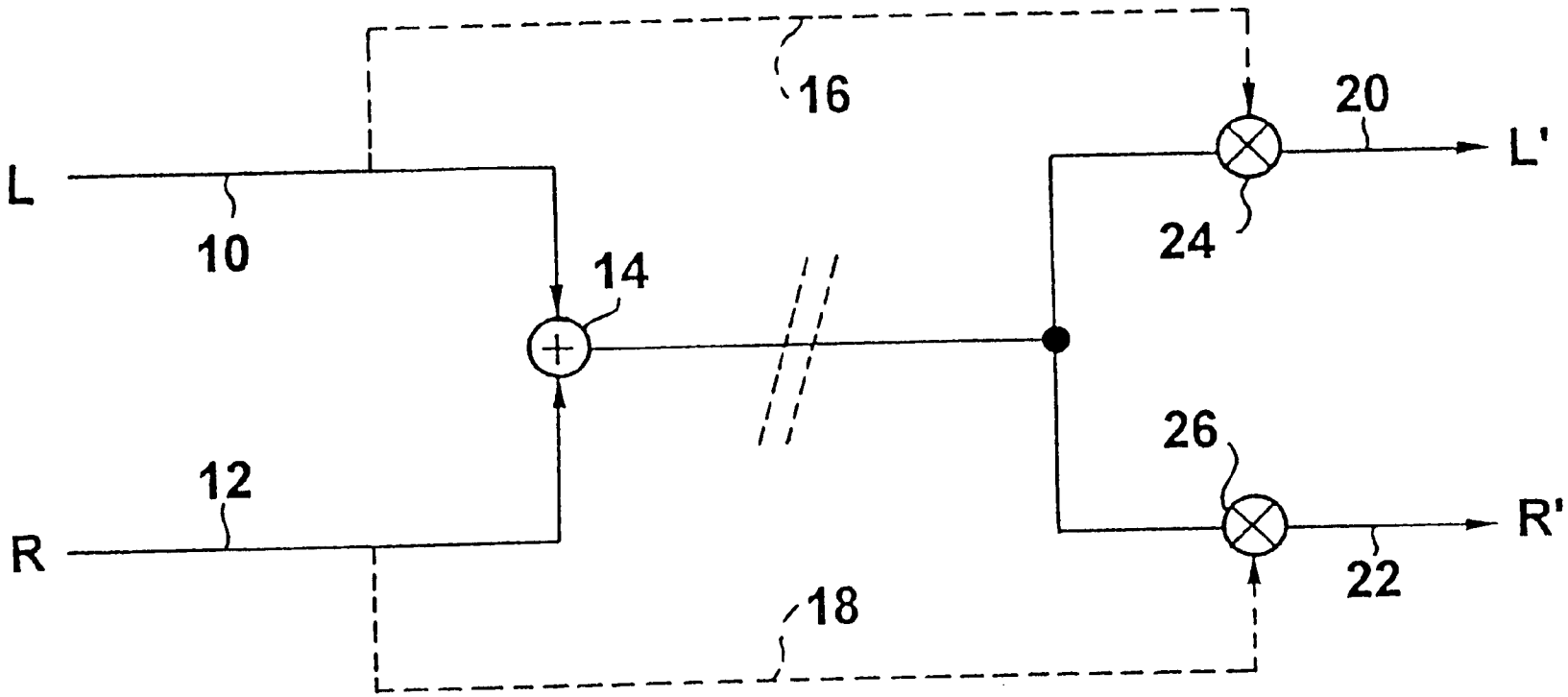
FIG. 1 shows the flow of signals in a coding/decoding diagram using the intensity stereo process.
Figure 2A:
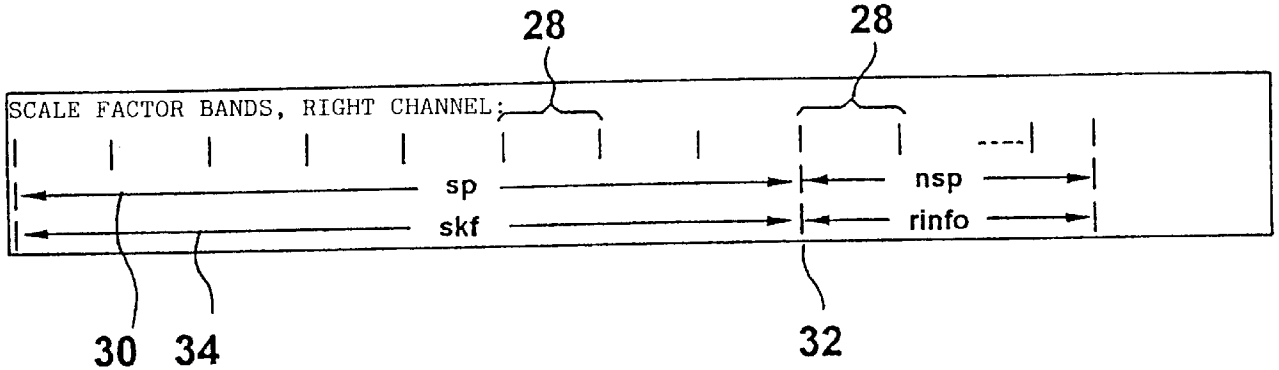
FIG. 2*a* shows a data format with stereo intensity coding present for the right channel, for the MPEG Layer 3 standard.
Figure 2B:
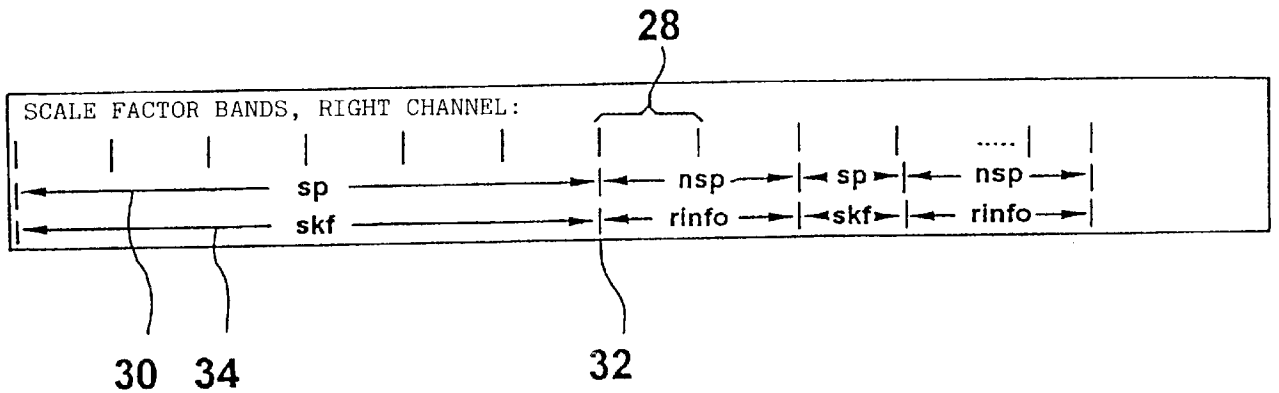
FIG. 2*b* shows a data format with stereo intensity coding present for the right channel, for the MPEG-NBC process.

FIG. 2*b* shows a format of the data for the right channel R with stereo intensity coding using the MPEG2-NBC process. The difference from FIG. 2*a* or the MPEG Layer 3 process is that a user of the MPEG2-NBC process now has the flexibility, selectively to connect or disconnect intensity stereo coding of the stereo audio spectral values for a respective section, even above the IS frequency limit 32. Thus the IS frequency limit is not actually a true frequency limit compared to MPEG Layer 3, as the IS coding can be disconnected or connected again even above the IS frequency limit in the NBC process. This was not possible with Layer 3, i.e. when IS coding was present for a section it was essential for the stereo audio spectral values above the IS frequency limit to be IS coded right to the top of the spectral range. The new NBC process need not activate IS coding for the whole spectral range above the IS limit; it allows IS coding to be disconnected if that is indicated. As the bit stream syntax for a section requires a code book number to be transmitted in any case, the side information or "overhead" is not increased with the indicating arrangement described, according to the invention.

The scale factors transmitted in a section with IS coding for the right channel also constitute the direction information 36, as in prior art, and these values themselves also undergo differential and Huffman coding. As already mentioned, there is a zero spectrum rather than stereo audio spectral values in the right channel, in the scale factor bands which are not IS coded. The left channel contains the total signal for the left and right channel in IS coded sections. However the total signal is standardised so that its energy within the respective scale factor bands is equal to the energy of the left channel, after IS decoding. In the event of IS coding being used in the decoder the left channel can therefore be taken up unchanged and need not be determined expressly by a re-scaling specification. The stereo audio spectral values for the right channel can be derived from those for the left channel using the direction information is_pos 36, which is in the side information of the right channel.

As described above, the stereo intensity process in prior art gives two coherent signals for the left and right channel, which differ only in amplitude, i.e. intensity, dependent on the direction information is_pos 36 (equations (4) and (5)).

As the presence of stereo intensity coding is indicated by two "non-real" code book numbers in the invention, a phase relationship between the two channels may be included. If the channels are in the same phase position, the calculating-back specification according to the invention, to be carried out in the decoder, is as follows:

$$R_i = 0.5^{\wedge}(0.25 \cdot \text{is_pos}(sfb)) \cdot L_i, \tag{7}$$

while in the event of phase opposition the spectrum is multiplied by −1, giving the following equation for calculating the right channel:

$$R_i = (-1) \cdot 0.5^{\wedge}(0.25 \cdot \text{is_pos}(sfb)) \cdot L_i. \tag{8}$$

In both the above equations $R_i$ refers to the calculated-back, i.e. decoded, stereo audio spectral values of the right channel. sfb is the scale factor band 28, with which the direction information is_pos 36 is associated. $L_i$ refers to the stereo audio spectral values of the left channel, which are taken up unchanged in the decoder.

Code book number 15 indicates whether the first calculating-back formula is to be used, while number 14 indicates that the second calculating-back formula is to be used, i.e. that the two channels are in phase opposition. It will be obvious to persons skilled in the art that the expressions "in phase" and "in phase opposition" are used in a broad sense in this application. For example a phase discriminator may be provided which determines that the signals are in phase opposition from a given initial value of the discriminator, e.g. 90°, while the signals are considered to be in phase when the phase difference is less than 90°.

In the first embodiment as described, the relative phase position of the two channels may be determined by the code book numbers 14 or 15 for a section comprising at least one scale factor band. The side information, produced by IS and phase indication, comprises 8 bit for a section, made up of four bit for the section length and four bit for the code book number 14 or 15. If an audio signal which has frequent changes of phase position in scale factor bands of its stereo audio spectral values has to be coded, a new section has to be started on each reversal of phase position from scale factor band to scale factor band, in the first embodiment. A signal with a frequently changing phase position thus produces very many sections, as each section can only indicate that the stereo audio spectral values in the two channels are either in phase or in phase opposition, through its associated code book number. An unfavourable signal will accordingly lead to a large number of sections and thus to a large amount of side information.

A second embodiment of the invention allows scale factor bandwide coding of phase position in a section where intensity coding is active. With this method according to the second embodiment, scale factor bandwise:phase position coding can be carried out without increasing the number of sections and without additional expenditure, through the use of an MS mask which will be described below.

It will be obvious to persons skilled in the art that the middle-side process and the intensity stereo process are mutually exclusive in a scale factor band. That is to say, the two processes are orthogonal.

If MS coding of stereo audio spectral values is used in a bit stream, an indication bit is appropriately set in the side information and connects the MS coding overall. The setting of the bit means that an MS bit mask is transmitted, thus enabling MS coding to be connected or disconnected selectively for each scale factor band (scfbd). One bit in the MS bit mask is reserved for each scale factor band, and hence the length of the bit mask corresponds to the number of bands.

MS scale factor information is not necessary in scale factor bands where IS is active, as MS coding must not be activated there. The MS bit mask may be used for other indicating purposes within that range. Thus it is possible to show details of the IS coding by means of the MS bit mask. As in the first embodiment, with IS coding information on the phase position of the channels in a section is given by means of the code book numbers 14 and 15. The numbers also show that IS coding is actually active in a section.

Unlike the first embodiment of the invention, in the second embodiment the MS bit mask is used to allow scale factor bands with different phase positions in a section. In relation to the code book number, which indicates that IS coding is active in a section, the function of the MS bit mask is to show the phase position of the individual scale factor bands in that section. If a bit in the MS bit mask for a scale factor band is not set (i.e. is zero), the phase information indicated by the code book number for the section containing the scale factor band will be retained, while if a bit in the MS bit mask for the scale factor band is set (i.e. is one), the phase position of the two channels indicated by the code book number for the section containing the scale factor band will be reversed. So basically there is an EXCLUSIVE-OR function between the phase position indicated by the code book number and the MS bit mask.

More specifically, the phase relationships of the two stereo channels L and R in a scale factor band contained in a section where IS coding is used are as follows, calculated from the code book number and the MS bit mask:

TABLE 1

| | | | | |
|---|---|---|---|---|
| Code book number (for a section) | 15 | 15 | 14 | 14 |
| MS bit mask (for a scale factor band) | 0 | 1 | 0 | 1 |
| Phase position of L and R | 0° | 180° | 180° | 0° |
| Calculating-back formula | eqn 7 | eqn 8 | eqn 8 | eqn 7 |

The second embodiment of the invention, already described, thus allows scale factor bands with stereo audio spectral values in different phase positions to appear in one section, whereby fewer sections than in the first example have to be formed for coding. Hence less side information has to be transmitted also.

Unlike the embodiment described above, other information relevant to a section may also be indicated by the additional code book numbers.

Other information relevant to a section may, for example, be a reference to the use of an adaptive Huffman coding in a section. With adaptive Huffman coding an adapted Huffman table may be produced dependent on the signal statistics. Code book number 13 instructs the encoder not to use any of the twelve fixed Huffman tables but to use an adapted one, which is not known a priori to the decoder. This is advantageous when the signal statistics in a section cannot be optimally coded, i.e. compressed, by one of the twelve permanently predetermined code books. Thus coding is no longer tied to the twelve fixed Huffman tables; it can produce and use a table optimally adapted to the signal statistics. The information about the adaptive code book is transmitted as additional side information.

A decoder needs this additional side information in order to derive the adapted Huffman table used in coding from it, so that the Huffman-coded stereo audio spectral values can be correctly decoded.

Figure 3:
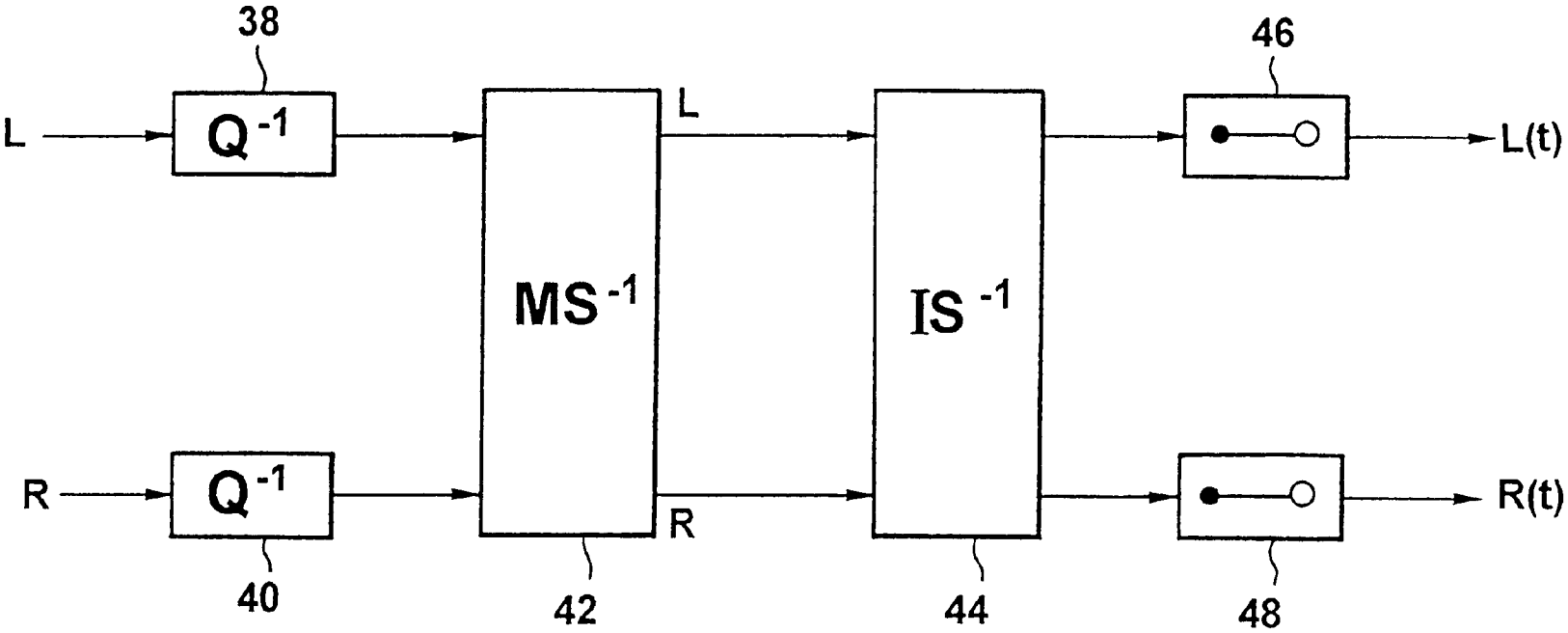
FIG. 3 is a block circuit diagram of a decoder carrying out the invention.

FIG. 3 is a simplified block circuit diagram of a decoder which can carry out the decoding method of the invention. Audio spectral values partly coded in the intensity stereo process are fed to respective reverse quantisers 38 and 40, the reverse quantisers cancelling the quantisation effected in coding. The dequantised stereo audio spectral values then pass into an MS decoder 42. The decoder 42 cancels the middle-side coding effected in the encoder. An IS decoder 44 now uses the previously described calculating-back formulas (7) and (8) to regain the original stereo audio spectral values for the IS coded scale factor bands. Respective re-conversion means for the left and: right channel now convert the stereo audio spectral values to stereo audio time values L(t), R(t). It will be obvious to persons skilled in the art that the re-conversion means 46 and 48 may operate e.g. by reverse MDCT.

What is claimed is:

1. A method of coding stereo audio spectral values, comprising the steps of:

grouping the stereo audio spectral values in scale factor bands with which scale factors are associated;

forming sections, each comprising at least one scale factor band;

allocating a predetermined code book out of a plurality of predetermined code books to at least one section, to obtain an allocated predetermined code book for the at least one section wherein each of the predetermined code books has assigned to it a unique code book number;

coding the stereo audio spectral values within the at least one section using the allocated code book, to obtain coded stereo audio spectral values for the at least one section;

transmitting a unique code book number assigned to be allocated code book as side information for the coded stereo audio spectral values in the at least one section at a code book number position required by a bit stream syntax for a section;

allocating an additional code book number to another section, wherein the additional code book number is not assigned to a predetermined code book out of the plurality of predetermined code books, the additional code book number signaling to a decoder, encoding information relevant to the another section, the encoding information not including a reference to a predetermined code book out of the plurality of predetermined code books;

transmitting the additional code book number as side information for the another section at the code book number position required by the bit stream syntax for a section;

wherein either a unique code book number assigned to a predetermined code book out of the plurality of predetermined code books or the additional code book number signaling the encoding information is transmitted at the code book number position required by the bit stream syntax, so that an amount of side information for a section that is not affected by signaling the encoding information to the decoder.

2. A method of decoding a coded signal having at least one section of coded stereo audio spectral values and another section, each section having, as side information, a code book number position required by a bit stream syntax, comprising the steps of:

detecting a code book number for each section of the coded signal at the code book number position based on the bit stream syntax for obtaining, for the at least one section, a detected unique codebook number being assigned to a predetermined code book out of a plurality of predetermined code books and for obtaining, for the another section, a detected additional code book number, wherein the additional code book number is not assigned to a predetermined code book out of the plurality of predetermined code books, the additional code book number signaling, to a decoder, encoding information relevant to the another section, the encoding information not including a reference to a predetermined code book out of the plurality of predetermined code books;

decoding the stereo audio spectral values of the at least one section, using a predetermined code book out of the number of predetermined code books, the predetermined code book having assigned to it the detected unique code book number; and decoding the another section using the encoding information signaled by the detected additional code book number.

3. The method according to claim 1 or 2, wherein a to be encoded signal includes a first section having spectral values of a first channel and a corresponding second section having spectral values of a second channel;

wherein the method further comprises the step of intensity stereo encoding the first and the second section to obtain intensity stereo encoded stereo audio spectrala values for the at least one section and a zero spectrum for the another section;

wherein the additional code book number is allocated to the another section, the additional code book number signaling to a decoder that the intensity stereo encoding has been performed for the first section and the second section.

4. The method according to claim 1 or 2, further comprises performing the step of adaptive Huffman encoding for stereo audio spectral values in the another section, the step of adaptive Huffman encoding including a step of producing an adapted Huffman code book based on signal statistics of the stereo audip spectral values in the another section and transmitting information on the adapted Huffman code book as additional side information for the another section;

wherein the additional code book number signals, to a decoder that adaptive Huffman encoding of the stereo audio spectral vaues of the another section has been performed.

5. The method according to claim 3, wherein the additional code book number also indicates, as encoding information, a phase relationship between the first section having spectral values of the first channel and the corresponding second section having spectral values of the second channel.

6. The method according to claim 5, wherein there exists, in addition to the additional code book number, another additional code book number, wherein one of the two additional code book numbers indicates as identical phase position of the first and second channels, and wherein the one of the two additional code book numbers indicating an identical phase position of the first and second channels is allocated to the another section, when the first and second channels have an identifcal phase position, the encoding information signaled to a decoder indicating that the following calculating-back formula is to be applied for intensity decoding in the decoder:

$$R_i=0.5\hat{}(0.25\cdot \text{is_pos}(sfb))\cdot L_i,$$

where $R_i$ are the stereo audio spectral values of a second channel, is _pos represents intensity direction information for a scale factor band sfb, and $L_i$ are the stereo audio spectral values of a first channel.

7. The method of according to claim 5, wherein there exists, in addition to the additional code book number, another additional code book number, wherein one of the two additional code book numbers indicates an opposing phase position of the first and second channels; and wherein the one of the two additional code book numbers indicating an opposing phsase position of the first and second channels is allocated to the another section, when the first and second channels have an opposing phase position, the encoding information signaled to a decoder indicating that the following calculating-back formula is to be applied for intensity decoding in the decoder:

$$R_i=(-1)\cdot 0.5\hat{}(0.25.\cdot \text{is_pos}(sfb))\cdot L_i,$$

where $R_i$ are the stereo audio spectral values of a second channel, is _pos represents intensity direction information for the scale factor band sfb, and $L_i$ are the stereo audip spectral values of a first channel.

8. The method according to claim 3, wherein the step of intensity stereo encoding forms a standardized sum signal of the stereo audio spectral values of the first channel and the second channel, in the at least one section, while in the another section a spectrum is zero, and intensity direction information is coded as side information.

9. The method according to claim 1, wherein a to be encoded signal includes a first section having spectral values of a first channel and a corresponding second section having spectral values of a second channel, further comprising the step of writing a bit mask which has a bit for each scale factor band;

wherein the step of writing includes setting or not setting a mask bit depending on a phase relationship of the first channel and the second channel and a valve of the additional code book number; and wherein the additional code book number signals, as encoding information, to a decoder that the decoder is to gate a bit on the mask for a scale factor band is gated with the additional code book number in a section, to determine the phase relationship of the first channel and the second channel.

10. The method according to claim 9, wherein the bit mask is an MS bit mask, and the additional code book numbers is to be gated with the MS bit mask scale factor band wise by means of an EXCLUSIVE-OR gate.

11. The method according to claim 2, wherein the additional code book number allocated to the another section signals to a decoder that intensity stereo encoding has been performed for a to be encoded signal including a first section having spectral values of a first channel and a corresponding second section having spectral values of a second channel; and wherein the step of decoding the another section includes the step of intensity stereo decoding using intensity stereo encoded spectral values obrained by the step of decoding the stereo audio spectral values of the at least one section and intensity encoding information from the another section to obtain intensity stereo decoded stereo audio spectral values for the first section and the second section.

12. The method according to claim 2, wherein, when generating the coded signal, the step of adaptive Huffman encoding for stereo audio spectral values in the another section has been performed, the step of adaptive Huffman encoding including producing an adapted Huffman code book based on signal statistics of the stereo audip spectral values in the another section and transmitting information on the adapted Huffman code book as additional side information for the another section, the method further comprising the following step:

when the additional code book number signals that adaptive Huffman encoding of the stereo audio spectral values of the another section has been performed, retrieving information on the adapted Huffman code book from the side information; and wherein the step of decoding the another section includes the step of Huffman decoding using the adaptive Huffman code book.

13. The method according to claim 11, wherein the additional code book number indicates, as encoding information, a phase relationship between the first section having spectral values of the first channel and the corresponding second section having spectral values of the second channel.

14. The method according to claim 13, wherein there exists, in addition to the additional code book number, another additional code book number, wherein one of the two additional code book numbers indicates an indentical phase position of the first and second channels;

wherein the one of the two additional code book numbers indicating an identical phase position of the first and second channels is allocated to the another section, when the first and second channels have an identical phase position; and wherein the step of decoding the additional section includes the step of applying the following calculating-back formula:

$$R_i=0.5\hat{}(0.25\cdot \text{is pos}(sfb))\cdot L_i$$

where $R_i$ are the stereo audio spectral values of a second channel, is _pos represents intensity direction information for a scale factor band sfb and $L_i$ are the stereo audio spectral values of a first channel.

15. The method according to claim 13, wherein there exists, in addition to the additional code book number, another additional code book number, wherein one of the two additional code book numbers indicates an opposing phase position of the first and second channels;

wherein the one of the two additional code book numbers indicating an opposing phase position of the first and second channels is allocated to the another section, when the first and second channels have an opposing phase position; and wherein the step of decoding the additional section includes the step of applying the following calculating-back formula:

$$R_i=(-1)\cdot 0.5\hat{}(0.25\cdot \text{is pos}(sfb))\cdot L_i$$

where $R_i$ are the stereo audio spectral values of a second channel, is _pos represents intensity direction information for the scale factor band sfb, and $L_i$ are the stereo audio spectral values of a first channel.

16. The method according to claim 11, wherein the step of intensity stereo encoding forms a standardized sum signal of the stereo audio spectral values of the first channel and the second channel, in the at least one section, while in the another section a spectrum is zero, and intensity direction information is coded as side information.

17. The method according to claim 2, wherein the coded signal is derived from a to be encoded signal, the to be encoded signal including a first section having spectral values of a first channel and a corresponding second section having spectral values of a second channel, the coded signal further comprising a bit mask which has a bit for each scale factor band, wherein a mask bit is set or not depending on a phase relationship of the first channel and the second channel and a value of the additional code book number; and wherein the step of decoding the another section includes the step of gating a bit on the mask for a scale factor band with the additional code book number in a section, to determine the phase relationship of the first channel and the second channel.

18. The method according to claim 17, wherein the bit mask is an MS bit mask, and the additional code book number is gated with the MS bit mask scale factor band wise by means of a EXCLUSIVE-OR gate.

19. An apparatus for coding stereo audio spectral values, comprising:

a means for grouping the stereo audip spectral values in scale factor bands with which scale factors are associated;

a means for forming section, each comprising at least one scale factor bandL;

a means for allocating a predetermined code book out of a plurality of predetermined code books to at least one section, to obtain an allocated predetermined code book for the at least one section, wherein each of the predetermined code books has assigned to it a unique code book number;

a means for coding the stereo audio spectral values within the at least one section using the allocated code book, to obtain coded stereo audio spectral values for the at least one section;

a means for transmitting a unique code book number assigned to the allocated code book as side information for the coded stereo audio spectral values in the at least one section at a code book number position required .by a bit stream syntax for a section;

a means for allocating an additional code book number ot another section wherein the additional code book number is not assigned to a predetermined code book out of the plurality of predetermined code books, the additional code book number signaling to a decoder, encoding information relevant to the another section, the encoding information not including a reference to a predetermined code book out of the plurality of predetermined code books; and a means for transmitting the additional code book number as side information for the another section at the code book number position required by the bit stream syntax for a section;

wherein either a unique code book number assigned to a predetermined code book out of the plurality of predetermined code books or the additional code book number signaling the encoding information is transmitted at the code book number position required by the bit stream syntax, so that an amount of side information for a section is not affected by signaling the encoding information to the decoder.

20. An apparatus for decoding a coded signal having at least one section of coded stereo audio spectral values and another section, each section having, as side information, a code book number position required by a bit stream syntax, comprising:

a means for detecting a code book number for each section of the coded signal at the code book number position based on the bit stream syntax;

a means for obtaining for the at least one section, a detected unique codebook number being assigned to a predetermined code book out of a plurality of predetermined code books;

a means for obtaining, for the another section, a detercted additional code book number, wherein the additional code book number is not assigned to a predetermined code book out of the plurality of predetermined code books, the additional code book number signaling, to a decoder, encoding information relevant to the another section, the encoding information not including a reference to a predetermined code book out of the plurality of predetermined code books;

a means for decoding the stereo audip spectral values of the at least one section using a predetermined code book out of the number of predetermined code books, the predetermined code book having assigned to it the detected unique code book number; and a means for decoding the another section using the encoding information signaled by the detected additional code book number.

* * * * *